US005305956A

United States Patent [19]

Wang

[11] Patent Number: 5,305,956

[45] Date of Patent: Apr. 26, 1994

[54] OSCILLATORY SPRINKLER

[76] Inventor: Po H. Wang, No. 91, Kuo Tai Rd., Chu Nan Chen, Miao Li Hsien, Taiwan

[21] Appl. No.: 119,872

[22] Filed: Sep. 10, 1993

Related U.S. Application Data

[63] Continuation-in-part of Ser. No. 924,164, Aug. 3, 1992, abandoned.

[51] Int. Cl.[5] ..... B05B 3/16

[52] U.S. Cl. ..... 239/242; 239/391; 239/394; 239/436; 239/DIG. 1

[58] Field of Search ..... 239/242, 596, 394, 447, 239/DIG. 1, 436, 237, 240, 390, 391, 392

[56] References Cited

U.S. PATENT DOCUMENTS

| | | | |
|---|---|---|---|
| 3,115,305 | 12/1963 | Rinkewich | 239/242 |
| 3,332,624 | 7/1967 | Rinkewich | 239/242 |
| 3,647,140 | 3/1972 | Perrot et al. | 239/394 |
| 3,854,665 | 12/1974 | Rodgers | 239/596 |
| 4,632,313 | 12/1986 | Rinkewich | 239/242 |
| 4,905,903 | 3/1990 | Katzer et al. | 239/436 |
| 5,052,622 | 10/1991 | Lindermeir et al. | 239/242 |

*Primary Examiner*—Andres Kashnikow
*Assistant Examiner*—Christopher G. Trainor
*Attorney, Agent, or Firm*—Poms, Smith, Lande & Rose

[57] ABSTRACT

An oscillatory sprinkler includes a base frame, an oscillatory unit, a water output tube, and a tubular socket. The water output has one end attached to the oscillatory unit and the other end pivotally attached to the base frame to allow oscillatory motion of the water output tube upon actuation of the oscillatory unit. The water output tube further has a plurality of water outputs. The tubular socket is rotatably mounted on the water output tube, having a plurality of faces. A strip with a plurality of sprinkling nozzles is removably attached to each face. Retaining members are provided in each face to retain the tubular socket in a desired position relative to the water output tube.

3 Claims, 4 Drawing Sheets

OSCILLATORY SPRINKLER

CROSS-REFERENCES TO RELATED APPLICATIONS

This is a continuation-in-part application of U.S. patent application Ser. No. 07/924,164 filed on Aug. 3, 1992, which is now abandoned.

BACKGROUND OF THE INVENTION

The present invention relates to an improved oscillatory sprinkler and, more particularly, to an oscillatory sprinkler with a rotatable tubular socket in which the sprinkling width and sprinkling angle thereof are adjustable.

Many kinds of sprinklers employing an oscillatory means for broadening the coverage of sprinkling area are currently on the market. Such sprinklers generally comprise a base frame, oscillatory means, and a tubular element containing a plurality of holes through which water is discharged. The oscillatory means enables the tubular element to oscillate back and forth, thereby allowing a fixed area of lawn to be watered. Furthermore, the oscillatory angle of such sprinklers is normally adjustable, providing a means for varying the sprinkling area in the vertical direction. Thus the sprinkling area can, to some extent, be tailored to suit the vertical dimension of a particular lawn.

However, using such sprinklers, there is no way to adjust the coverage of sprinkling area in the horizontal direction. Consequently, the user must periodically adjust the location of his sprinkler in order to completely cover his lawn. Therefore, there has been a long and unfulfilled need for an improved oscillatory sprinklers to mitigate and/or obviate the aforementioned problems.

SUMMARY OF THE INVENTION

The present invention provides an oscillatory sprinkler which includes a base frame, an oscillatory means, a water output tube, and a tubular socket. The water output has one end attached to the oscillatory means and the other end pivotally attached to the base frame to allow oscillatory motion of the water output tube upon actuation of the oscillatory means. The water output tube further has a plurality of water outputs. The tubular socket is rotatably mounted on the water output tube, having a plurality of faces. A strip with a plurality of sprinkling nozzles is removably attached to each face. One of the faces is selectively in alignment with water outputs of the water output tube, providing selective sprinkling.

Another feature of the present invention is that the water output has a gasket mounted therearound, and each face of the tubular socket has a retaining means for contacting with the gasket, thereby retaining the tubular socket in a secure angular relationship with respect to the water output tube.

Other advantages and novel features of the invention will become more apparent from the following detailed description when taken in conjunction with the accompanying drawings.

DETAILED DESCRIPTION OF THE PREFERRED EMBODIMENTS

Figure 1:
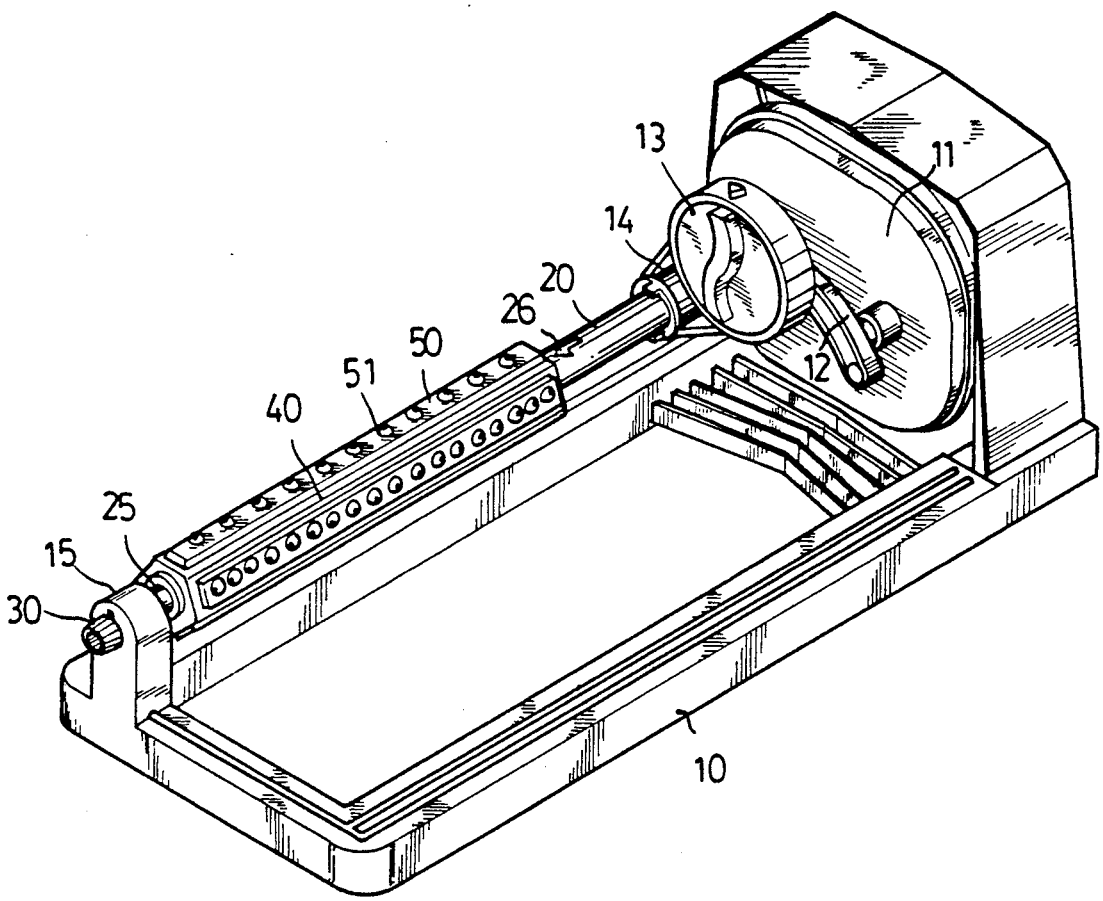
FIG. 1 is a perspective view of an improved oscillatory sprinkler in accordance with the present invention.
Figure 2:
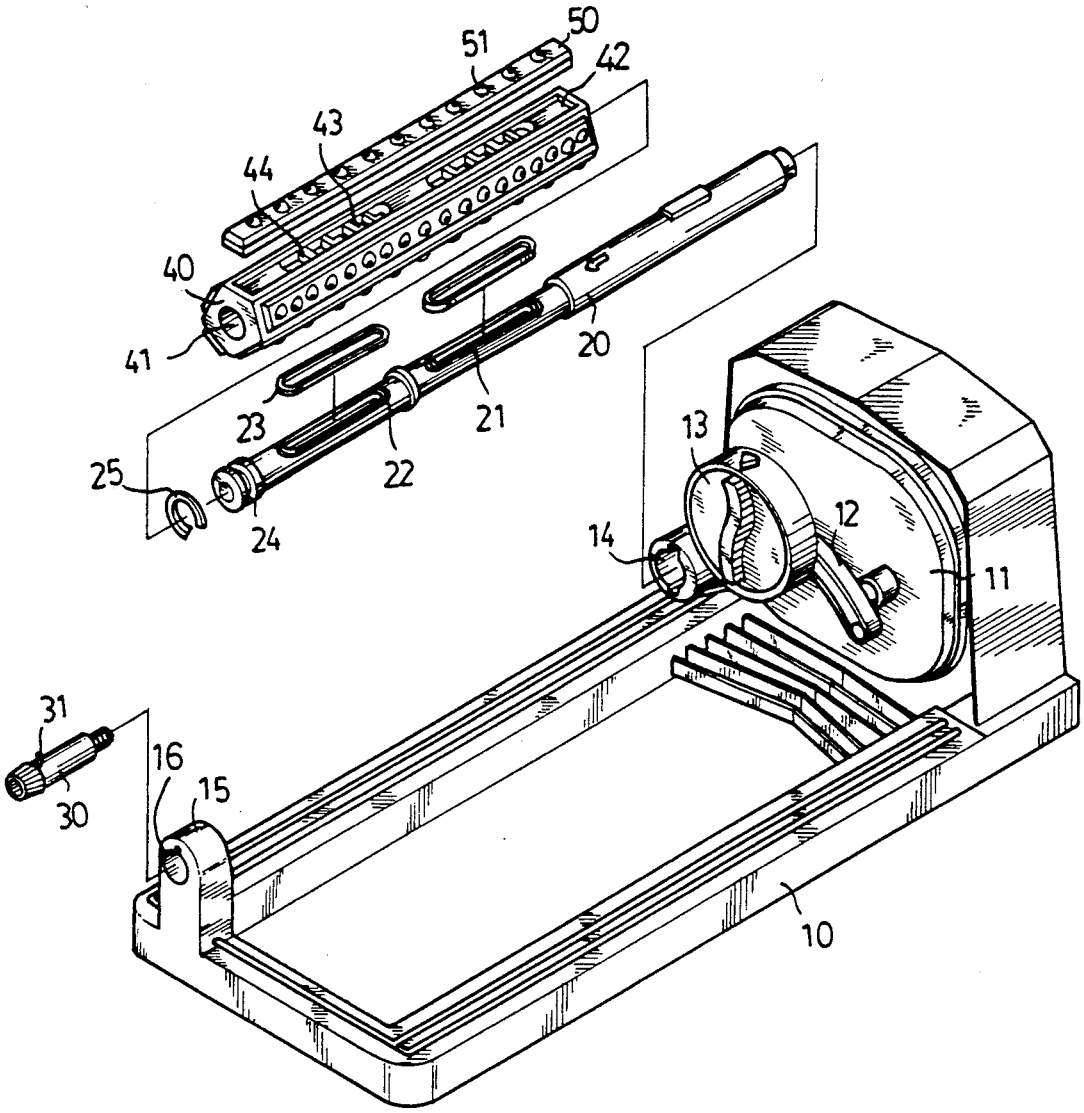
FIG. 2 is an exploded view of the oscillatory sprinkler.

Referring to the drawings and initially to FIGS. 1 and 2, an oscillatory sprinkler in accordance with the present invention generally includes a base frame 10, an oscillatory means 11, a water output tube 20, and a tubular socket 40 which is the unique characteristic of the invention. The water output tube 20 has one end attached to the oscillatory means 11 by means of a coupler 14 and the other end pivotally attached to the base frame 10 by means of a fastening plug 30 passing through a seat 15 on the base frame in which the fastening plug 30 has a pin 31 thereon for engaging with a corresponding slot 16 in the seat 15. The oscillatory means 11 includes an oscillatory arm 12 for urging oscillatory motion of the water output tube 20 and an adjusting knob 13 for adjusting the oscillatory angle of the oscillatory arm 12. Water is inputted from the rear side of the base frame, then enters the oscillatory means 11 to cause oscillatory motion of the water output tube 20. The structure and operation of the oscillatory means 11 are conventional and less relevant to the invention and therefore no further discussion is required.

The water output tube 20 has two water outputs 21 and a gasket 23 is mounted on a gasket groove 22 formed around each water output 21. Furthermore, an annular groove 24 is formed in one end of the water output tube 20 for mounting the tubular socket 40 by means of a substantially C-shaped ring 25.

Figure 3:
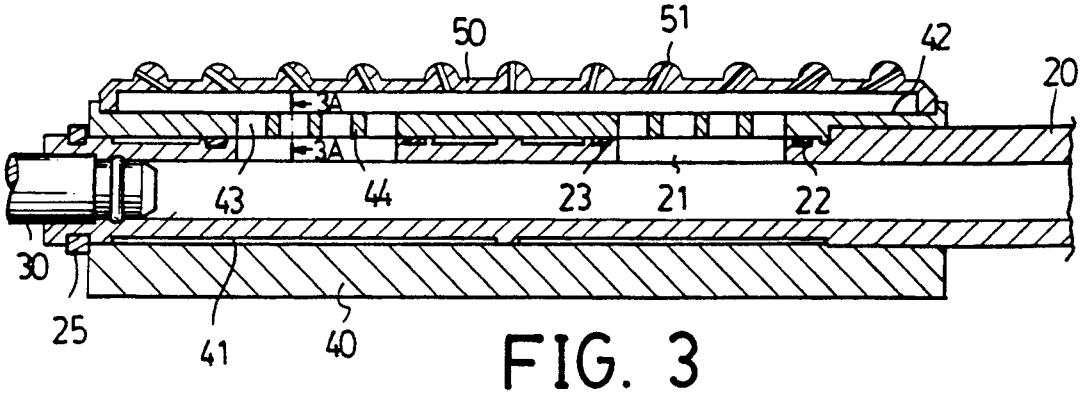
FIG. 3 is a partial cross-sectional view of the water output tube and the tubular socket of the oscillatory sprinkler.
Figure 4:
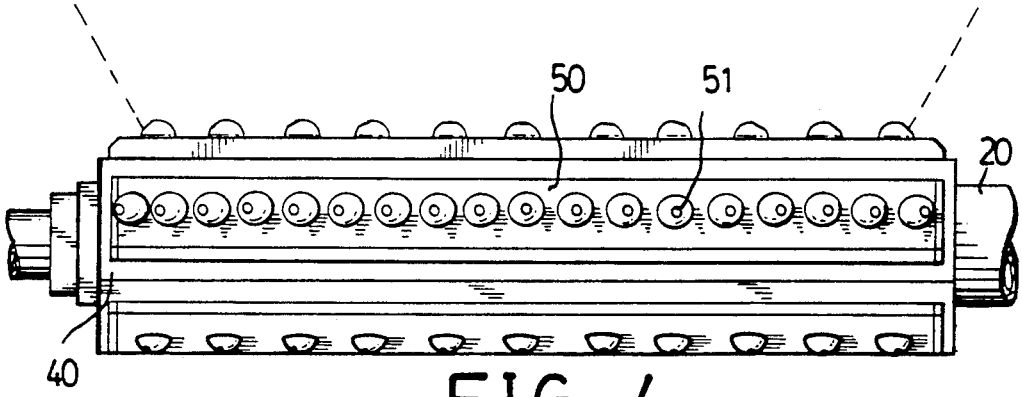
FIG. 4 is a schematic view showing the outer arrangement of the tubular socket.
Figure 5:
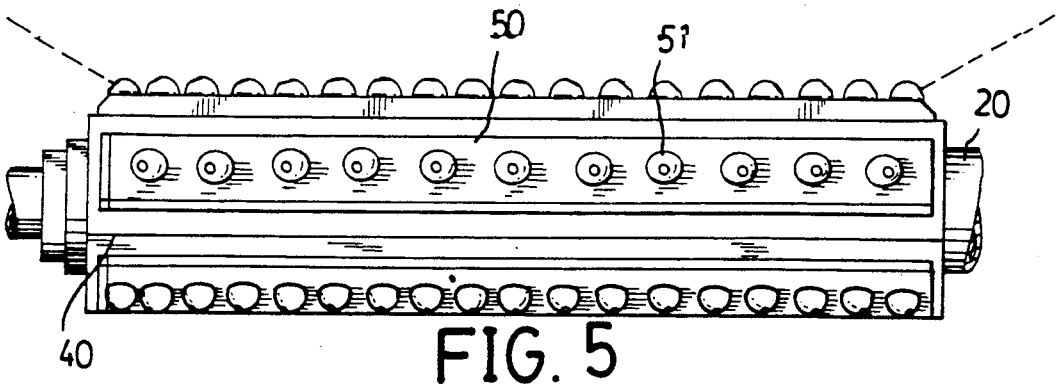
FIG. 5 is a schematic view similar to FIG. 4, wherein the tubular socket is turned to another face.

The tubular socket 40 is polyhedral, in that it has a central bore 41 through which the water output tube 20 passes and a plurality of faces 42. Referring to FIGS. 2 and 3, each face 42 has a plurality of holes 43 separated by a plurality of retaining members 44. A strip 50 with a plurality of sprinkling nozzles 51 is removably mounted to each face 42. In this embodiment, there are five strips 50 in which the distance between two adjacent sprinkling nozzles 51 therein and the sprinkling angle provided by the sprinkling nozzles 51 are different from each other (see FIGS. 4 and 5 in which the dashed lines represents the sprinkling direction).

The tubular socket 40 is rotatably mounted on the water output tube 20 with one of the strips 50 appropriately in alignment with the water outputs 21. In other words, the user may select the strip with desired sprinkling nozzles, install the strip on one of the faces and then place the strip in alignment with water outputs of the water output tube under the aid of the arrow 26 on the water output tube 20.

Figure 3A:
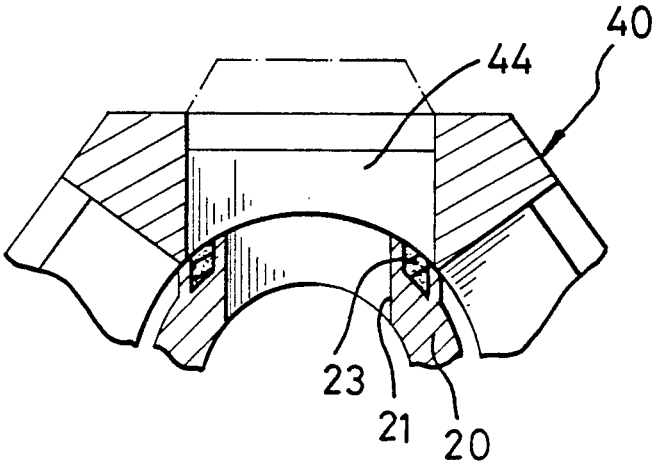
FIG. 3A is an enlarged cross-sectional view taken along line 3A—3A of FIG. 3.

As shown in FIG. 3A, after assembly, the retaining members 44 contact with the gaskets 23 such that a frictional force exists between the retaining members 44 and the gaskets 23 so as to retain the tubular socket 40 in any desired position where one of the strips 50 is in alignment with the water outputs 21. By such an arrangement, it is not necessary to provide additional means to position the tubular socket 40 relative to the water outputs 21. The retaining members 44 also retain the gaskets 23 in the associated grooves 22, preventing the gaskets 23 from protruding into the holes 43 which might affect the sprinkler result.

Figure 6:
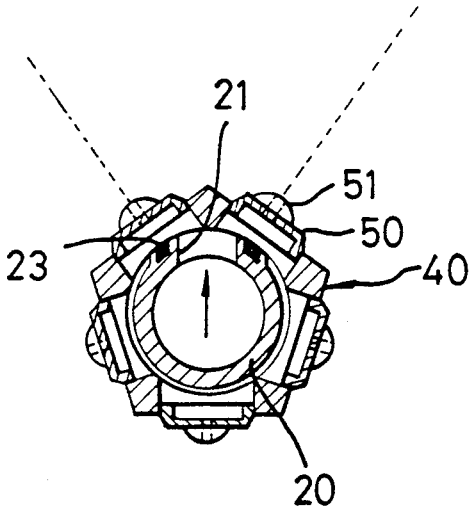
FIG. 6 is a cross-sectional side view of the oscillatory sprinkler in which the water outputs communicate with two faces of the tubular socket.

Referring to FIG. 6, another advantage of the present design is that, due to the provision of the gaskets 23 and the retaining members 44, when the number of the faces 42 of the tubular socket 40 exceeds five (5), by aligning the middle point of two adjacent faces 42 of the socket 40 with the arrow 26, the water outputs 21 of the output tube 20 may communicate with the nozzles 51 in the two strips 50 on the two adjacent faces 42 of the tubular socket 40, providing an additional sprinkling pattern which cannot be provided by any existing oscillatory sprinklers and rotational sprinklers.

According to the above description, it is appreciated that the invention provides optional selection for sprinkling, i.e., the sprinkling width and sprinkling angle are variable responsive to different lawns, which cannot be achieved by conventional oscillatory sprinklers.

Although the invention has been explained in relation to its preferred embodiment, it is to be understood that many other possible modifications and variations can be made without departing from the spirit and scope of the invention as hereinafter claimed.

I claim:

1. An oscillatory sprinkler comprising:

a base frame;

an oscillatory means;

a water output tube with one end thereof attached to said oscillatory means and the other end thereof pivotally attached to said base frame to allow oscillatory motion of said water output tube upon actuation of said oscillatory means, said water output tube having at least one water output and a gasket mounted around said water output; and a tubular socket rotatably mounted around said water output tube, having more than four faces each with a plurality of holes and a plurality of retaining members separating said holes, a strip with a plurality of sprinkling nozzles being removably attached to each said face, said retaining members being in a frictional contact relationship with said gasket to retain said gasket and retain said tubular socket in a desired position relative to said water output tube.

2. The oscillatory sprinkler as claimed in claim 1, wherein said sprinkling nozzles on each said strip are different from each other in sprinkling width and sprinkling angle thereof.

3. The oscillatory sprinkler as claimed in claim 1, wherein said water output and said tubular socket are configured such that, when said water output is aligned between two of said faces, said water output communicates with said sprinkling nozzles of said strips which are attached to said two of said faces respectively.

* * * * *